US009811107B2

(12) United States Patent
Marinca

(10) Patent No.: US 9,811,107 B2
(45) Date of Patent: Nov. 7, 2017

(54) LOW POWER BIAS CURRENT GENERATOR AND VOLTAGE REFERENCE

(71) Applicant: Analog Devices Global, Hamilton (BM)

(72) Inventor: Stefan Marinca, Limerick City (IE)

(73) Assignee: Analog Devices Global, Hamilton (BM)

( * ) Notice: Subject to any disclaimer, the term of this patent is extended or adjusted under 35 U.S.C. 154(b) by 20 days.

(21) Appl. No.: 14/789,477

(22) Filed: Jul. 1, 2015

(65) Prior Publication Data

US 2017/0003704 A1 Jan. 5, 2017

(51) Int. Cl.
*G05F 1/10* (2006.01)
*G05F 3/26* (2006.01)

(52) U.S. Cl.
CPC ..... *G05F 3/267* (2013.01)

(58) Field of Classification Search
CPC ..... H01L 2924/00; H01L 2924/3011; H01L 2224/16225; H01L 2224/32225; H01L 2224/73204
See application file for complete search history.

(56) References Cited

U.S. PATENT DOCUMENTS

2007/0108957 A1* 5/2007 Noda ..... G05F 3/262 323/314
2009/0160539 A1* 6/2009 Hsieh ..... G05F 3/262 327/543
2009/0243713 A1* 10/2009 Marinca ..... G05F 3/30 327/542
2015/0028953 A1* 1/2015 Kovac ..... H03F 1/0261 330/255

* cited by examiner

*Primary Examiner* — Sibin Chen
(74) *Attorney, Agent, or Firm* — Schwegman Lundberg & Woessner, P.A.

(57) ABSTRACT

A bias current generators that may be implemented in low power environments is described. The current generator can be implemented without using resistors and may be used to generate reference currents and voltages. It may also be used to generate voltage references where the output of the circuit is to at least a first order temperature independent.

22 Claims, 4 Drawing Sheets

LOW POWER BIAS CURRENT GENERATOR AND VOLTAGE REFERENCE

FIELD

The present invention relates to bias current generators that may be implemented in low power environments. Particularly the invention relates to a low power bias current generator that can be implemented without using resistors. Such a current generator may be used to generate reference currents and voltages. It may also be used to generate voltage references where the output of the circuit is to at least a first order temperature independent.

BACKGROUND

Bias current generators are found in most of today's silicon based integrated circuits. They are designed to provide a bias current to different circuit blocks and find particular use in analog sub-circuits. A bias current is typically generated by reflecting a voltage across a resistor. A very popular bias current generator is based on the base-emitter voltage difference of two bipolar transistors operating at different collector current densities. This voltage is, by its nature, proportional to absolute temperature, denoted as PTAT. There are also bias current generators based on base-emitter voltage or gate to source voltage of MOS transistors. As the base-emitter voltage of a bipolar transistor is complementary to absolute temperature, CTAT, the generated current has a similar temperature dependency and is denoted CTAT.

While these generators find many uses, there are many constraints on modern bias current generators such as: minimum supply voltage, low power, low silicon area for low cost, precision, the capacity to trim the circuits to optimise performance, noise, etc. When a very low power bias current is required the resistor used to convert the voltage in a corresponding current dominates the die area and the associated cost.

SUMMARY

Accordingly the present teaching provides a bias current generator that uses MOS devices to generate a bias current that is related to a voltage difference between two bipolar transistors that operate at different current densities. This voltage difference or $\Delta V_{BE}$ is intrinsically PTAT in form. This voltage depends only on base-emitter voltage difference. The aspect ratio of individual ones of the MOS devices operating in the triode region sets the corresponding resistor value which in turn sets the corresponding current value and by reflecting this voltage across a MOS device that is configured to act as a resistor, a corresponding PTAT current is generated. The PTAT current is related to the ratio of the $\Delta V_{BE}$ to the $R_{ON}$ of the MOS device.

DETAILED DESCRIPTION OF THE DRAWINGS

The present teaching will now be described with reference to exemplary circuit configurations which may be usefully employed to provide a bias current generator that that uses MOS devices to generate a bias current that is related to a voltage difference between two bipolar transistors that operate at different current densities. This voltage difference or $\Delta V_{BE}$ is intrinsically PTAT in form and by reflecting this voltage across a MOS device that is configured to act as a resistor, a corresponding PTAT current is generated. The PTAT current is related to the ratio of the $\Delta V_{BE}$ to the $R_{ON}$ of the MOS device.

Figure 1:
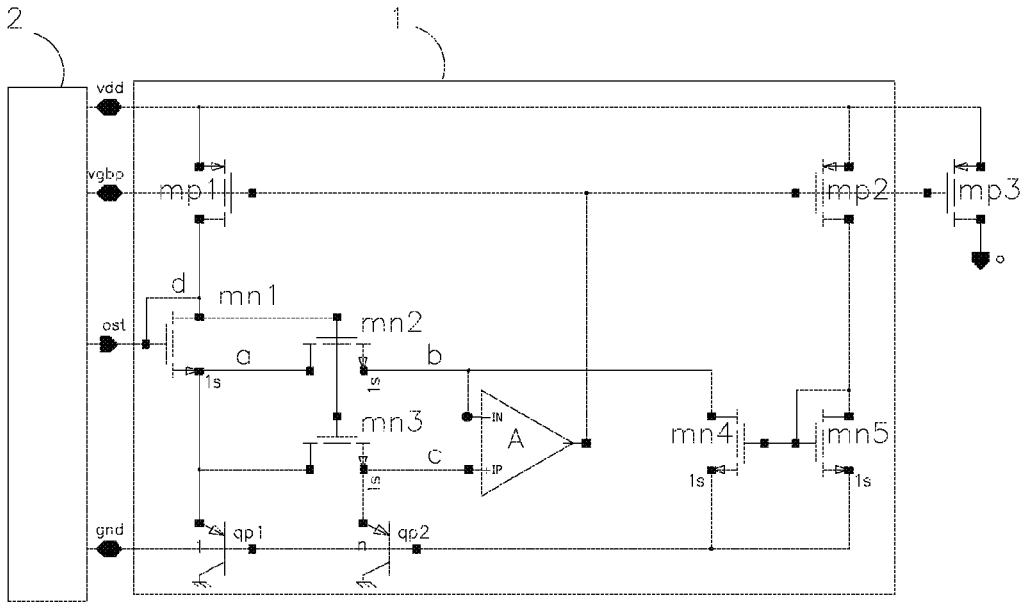
FIG. 1 is a schematic of a current generator that is implemented in accordance with the present teaching.

As shown in FIG. 1, a bias current generator 100 in accordance with the present teaching can be implemented for very low power environments, utilising very low operation voltage and avoiding the use of resistors. Such a circuit is also advantageous in that it occupies a smaller amount of silicon area than would be required for a circuit incorporating resistors.

The circuit of FIG. 1 consists of a current generator block, 1, and a start-up block, 2. The start-up block is used for initial start-up only. The current generator block 1 comprises two bipolar transistors, qp1 and qp2, operating at different collector current densities—in this configuration qp2 is a scaled version of qp1 and operates a lower current density than qp1. In this way operationally a voltage difference or $\Delta V_{BE}$ can be generated between the two bipolar transistors. While shown as two unique devices, it will be appreciated that this is a simplified representation and that each bipolar transistor shown can be fabricated from a plurality of individual such devices.

Three NMOS transistors, mn1, mn2, mn3 are provided and are arranged so as to share a common gate node, "d". A first one of the NMOS devices is configured as a common biasing MOS device and in this exemplary arrangement is diode connected. The biasing MOS device, mn1, is coupled to the others of the NMOS devices which are arranged in a stack, thereby forming a stacked array of NMOS devices, mn2, mn3. This plurality of stacked MOS devices are coupled to the first bipolar transistor and the second bipolar transistor, are biased by the common biasing MOS device, mn1, which is also coupled to the first bipolar transistor.

As discussed above, the first and second bipolar transistor are configured relative to one another to generate a $\Delta V_{BE}$ voltage that is related to a difference in their respective base emitter voltages. This $\Delta V_{BE}$ voltage is reflected across the plurality of stacked MOS devices to generate a bias current, the bias current being related to the $\Delta V_{BE}$ voltage and an on resistance of the MOS devices. As is evident from FIG. 1, each of the biasing MOS device and the plurality of stacked MOS devices across which the $\Delta V_{BE}$ voltage is reflected are arranged in a stack configuration sharing a common gate node.

An amplifier A is coupled to the stacked NMOS transistors mn2 and mn3 and similarly to the bipolar devices qp1 and qp2 and is arranged such that its two input nodes "b" and "c" are maintained at the same potential. The stacked MOS devices comprising a first MOS device mn2 coupled to a first input of the amplifier and a second MOS device mn3 coupled to a second input of the amplifier. The two NMOS transistors mn2 and mn3 which form the plurality of stacked MOS devices are biased to operate in triode region and therefore act as resistors, having an effective resistance value RON. In this way a current which is related to the value of $\Delta V_{BE}/R_{on}$ can be generated at the node b.

It will also be appreciated from FIG. 1 that a drain voltage of each of the biasing MOS device and the plurality of MOS devices across which the $\Delta V_{BE}$ voltage is reflected is determined by the $\Delta V_{BE}$ voltage.

The bias current is related to the $\Delta V_{BE}$ voltage and the corresponding drain to source resistance of the stacked MOS devices mn2, mn3.

The stacked MOS devices are coupled between current mirrors, formed from first and second sets of MOS devices. A first current mirror is formed from a first set of MOS devices, in the arrangement of FIG. 1 formed by a pair of NMOS transistors, operating as current mirrors, mn4 and mn5. This first set of MOS devices are provided and are arranged to mirror the current provided at node b. A second current mirror is formed from a second set of MOS devices. In the arrangement of FIG. 1 this is provided by a pair of PMOS transistors mp1 and mp2 and an output device mp3 all operating as current mirrors and arranged relative to the first current mirror mn4 and mn5 such that a current related to the $\Delta V_{BE}$ generated between the two bipolar transistors qp1, qp2 can be mirrored.

The difference in collector current density of qp1 and qp2 is usually set by their emitter area difference. The drain currents of mp1 and mp2 are forced via the amplifier A such that the two nodes "b" and "c" have the same voltage and the base-emitter voltage difference of qp1 and qp2 is reflected from the nodes "a" and "b" and "a" and "c". The drain current of mp2 is mirrored via mn5, diode connected, to the drain current of mp4 such that mn2 and mn4 have the same drain current. The drain current of mp1, always larger than the drain current of qp2, is divided in three components: the emitter current of qn1 and the drain currents of mp2 and mp3.

In normal operation, with "b" and "c" at the same potential, the drain currents of mn2 and mn3, assumed to be identically, are:

$$I_{(mn2,d)} = I_{(mn3,d)} = \frac{V_a - V_b}{r_{on}} = \frac{\Delta V_{be}}{r_{on}} = \frac{\frac{kT}{q} * \ln(n)}{r_{on}} \quad (1)$$

The symbols in (1) are:

$r_{on}$, the drain to source resistance of mn2 and mn3;

k, Boltzmann's constant;

T, absolute temperature;

q, electron charge;

n, the emitter area ratio of qp2 to qp1.

Further assuming that each of the MOS devices mn4 and mn5 have the same aspect ratio, then it will be appreciated by those of skill in the art that the currents of mp2, the unity bias current, and mn2 have the same value. In this way it will be appreciated that the bias current is provided at a drain of one of the MOS devices forming the second set of MOS devices, the bias current being related to the source drain voltage of the one of the MOS devices forming the second set of MOS devices. As the output of the amplifier is coupled to a common gate of the second set of MOS devices of the current mirrors it drives the source drain voltage of the second set of MOS devices.

The current mirror formed by the second set of MOS devices is also coupled to a common gate node of the biasing MOS device. an aspect of ratio of the MOS devices, mp1, mp2, mp3 forming the second set of MOS devices is configured such that a bias voltage provided by the second set of MOS devices to the common gate node of the biasing MOS device mn1 is also used to bias the bipolar transistors and to provide a bias current for the first set of MOS devices mn4, mn5. This is typically achieved by having MOS device mp1 provided with a greater aspect ratio than MOS device mp2. The drain current of mp1 is divided in three components: the drain current of mn2, the drain current of mn3 and the emitter current of qp1. It is important that the drain current of mp1 is larger than the originating current at node b to ensure that there is sufficient current to bias the bipolar transistors. There are a variety of design options that could be considered for ensuring this design requirement. One design option could be to make mp1 larger than mp2, for example three times larger such that the current components coupled to the drain current of mp1 have the same value. Another configuration is to scale the current at the first current mirror mn4, mn5 such that a scaled version is then passed to the second current mirror and then to device mp1. Combinations of the two configurations are also possible.

It will be understood that the current at node b which is related to $\Delta V_{BE}/R_{on}$ can be reflected across the circuit and a current similar in PTAT form to this current can be taken from the circuit at node "o", the drain of MOS device mp3. This current can be considered the output current of the bias current generator. The output current of the circuit can be provided as a scaled value of the bias current as determined by an aspect ratio of individual ones of the MOS devices in the current mirrors. The aspect ratio of either the MOS devices forming the first set of MOS devices or an aspect ratio of the MOS devices forming the second set of MOS devices can used to determine the scaled value of the output current.

Figure 2:
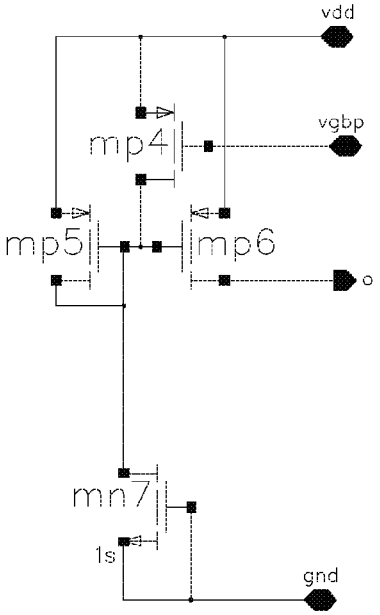
FIG. 2 shows an example of how the start-up circuit of FIG. 1 can be implemented.

To allow the bias current generator block 1 initialise, it is necessary to provide a start-up circuit 2. Different start-up circuits are known and it will be appreciated that the function of the start-up circuit is restricted to start-up situations. The start-up circuit 2 is coupled to the second set of MOS devices mp1, mp2, mp3 and to the common gate node of the biasing MOS device mn1 to operably provide a gate voltage during start-up operation of the generator. An example of a circuit that may be implemented in a low power and low supply voltage environment such as that of the present teaching is presented in FIG. 2 and comprises a plurality of MOS Devices. Here a native NMOS device, mn7, having a negative threshold voltage, with its source and gate terminals connected to "gnd" is configured to generate a drain current. This current is mirrored via a diode connected PMOS device mp5 and another PMOS device, mph, such that the drain current of mn6 can be used to initiate the start-up of the bias current generator, 1.

Figure 3:
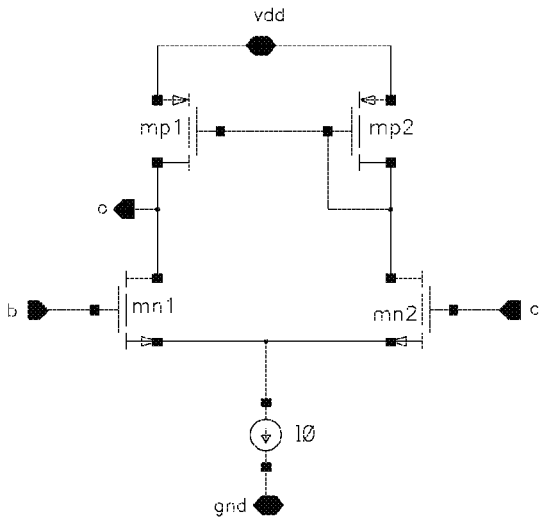
FIG. 3 shows an example of how the amplifier of FIG. 1 can be generated.

The amplifier A functions as a very simple amplifier and can be implemented accordingly in a relatively unsophisticated fashion. An example of a single stage differential amplifier that can be usefully employed is shown in FIG. 3, where I0 represents the tail current. For very low power the amplifier I0 can consist of a single native device, similar to mn7 of FIG. 2.

The circuit of FIG. 1 operates as follow. The start-up current injected to the node "d" is divided in three currents as: drain current of mn2, drain current of mn3 and the emitter current of qp1. A positive voltage relative to ground is generated on the node "b", the inverting node of the amplifier A, such that the output node of the amplifier and the common gate node of mp1, mpg and mp3 are forced low. The amplifier reacts with a corresponding output voltage level to force its two inputs at the same potential, per normal operating performance of an amplifier.

By providing the NMOS transistors mn1, mn2 and mn3 as native NMOS transistors, similarly to the NMOS device mn7 of the start-up circuit, the circuit of FIG. 1 can be operated at very low supply voltage.

As was discussed above, the MOS devices mn2 and mn3 act as resistors with their resistor values modulated by the aspect ratio of MOS device mn1. In this way the values of the MOS device mn1 can be used to modulate the temperature dependency of the on resistance, $R_{ON}$ of mn1 and mn2.

The value of the bias current generated by the circuit of FIG. 1 can be trimmed to a specific value to correct for process variability. It will be appreciated that the bias current is related to the value of the $R_{ON}$ of the MOS devices and an example of how this effective resistance can be varied in a digital fashion is presented in FIG. 4 and FIG. 5.

Figure 4:
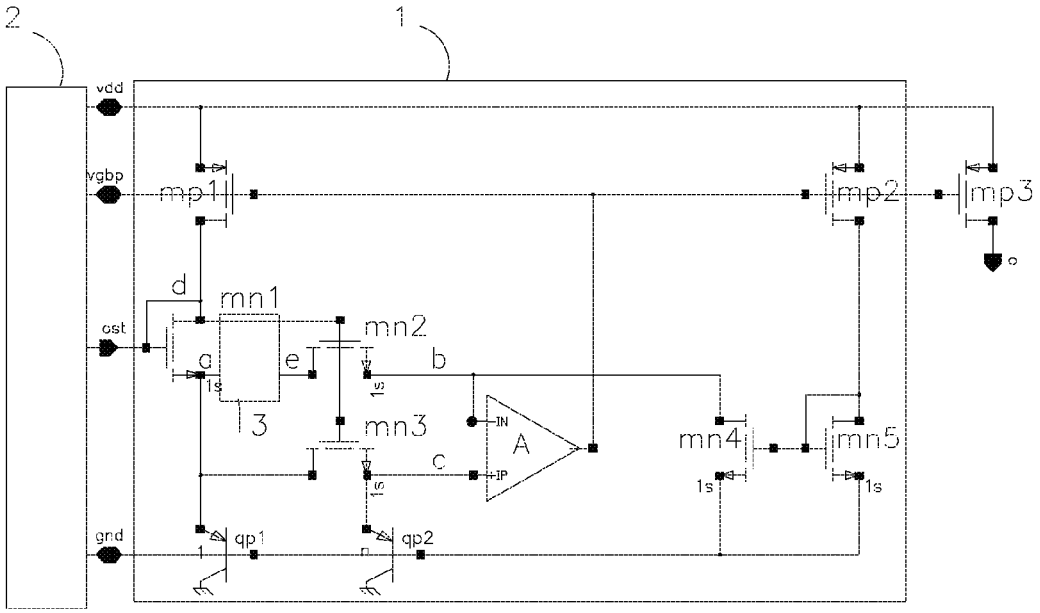
FIG. 4 shows a variation to the circuit of FIG. 1.
Figure 5:
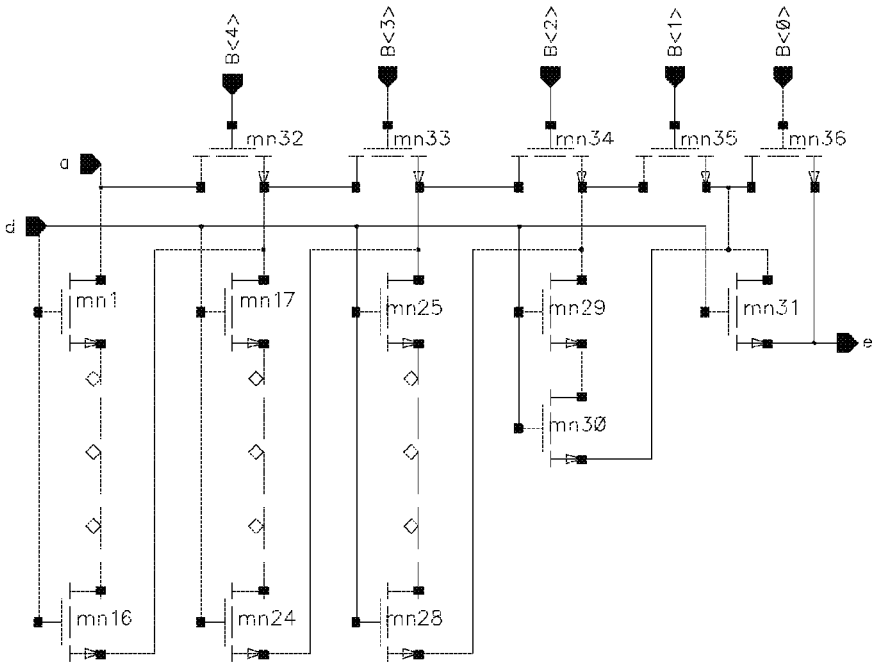
FIG. 5 shows how a trimming block per the teaching of FIG. 4 could be implemented.

In series with mn2 of FIG. 4, between the nodes "a" and "e", a trimmable element 3 which may be provided by a chain of NMOS transistors, mn1 to mn31, according to FIG. 5 is inserted. This trimmable element 3 is coupled between the stacked MOS devices and the biasing MOS device mn1 and is used to vary the current biasing each of the first set of MOS devices mn4, mn5 and the second bipolar transistor qp2. In this example by providing a chain of 32 MOS devices which are digitally controlled, the value of the resistance between the nodes "a" and "e" can be binary trimmed in thirty two steps via the trimming codes, B<4>to B<0>. For all codes set as logic zero the resister value has its maximum value. As the logic codes get high the corresponding resistance is reduced in a binary fashion. For all codes set as logic high the NMOS string is shorted and the resister value gets its minimum value. In this way a digital binary weighting can be judiciously selected to provide a variation in the effective resistance provided by the MOS devices.

Figure 6:
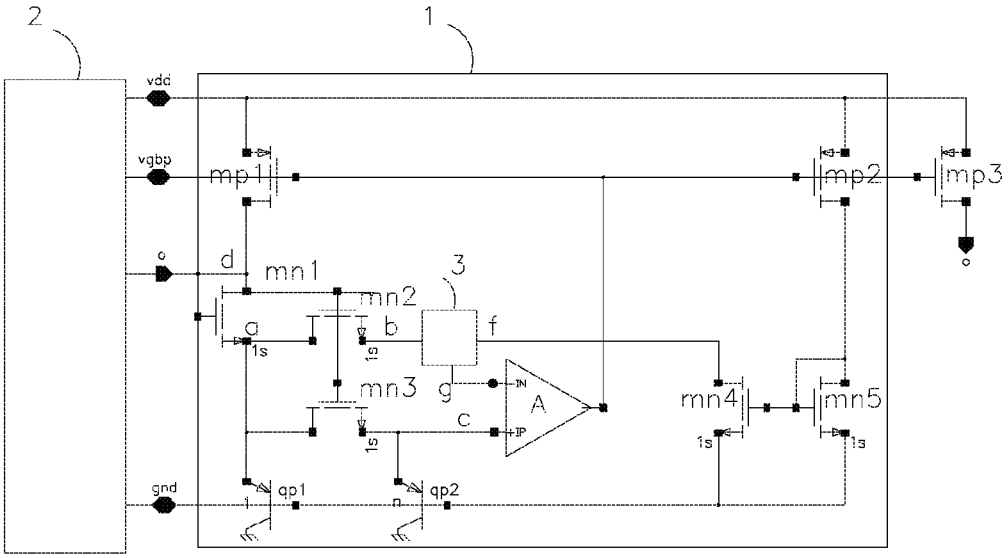
FIG. 6 shows another variation to the circuit of FIG. 1.
Figure 7:
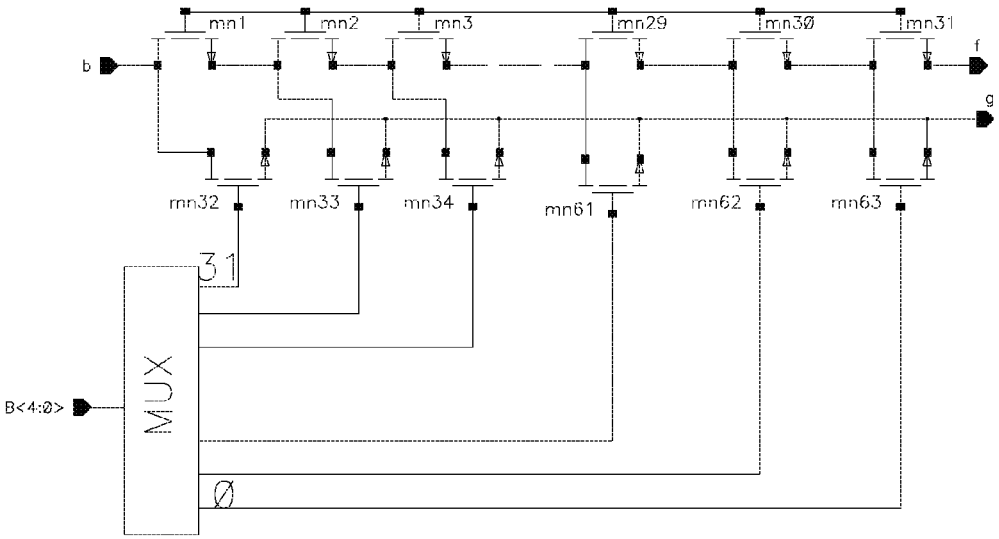
FIG. 7 shows how a trimming block per the teaching of FIG. 6 could be implemented.

An alternative solution to avoid voltage drop across the switches, mn32 to mn36 of FIG. 5, is presented in FIG. 6 and FIG. 7 where a trimmable element 3 is provided between the stacked MOS devices mn2, mn3 and an input to the amplifier, a value of the trimmable element 3 being operably used to vary a value of the $\Delta V_{BE}$ voltage used to generate the bias current.

As FIG. 6 and FIG. 7 shows it is possible to provide a chain of trimming NMOS transistors, mn1 to mn31, connected between the nodes "b" and "f". The voltage drop across the chain can be selected in a thermometric fashion, one by one, via a multiplexer, MUX, i.e. the trimmable element comprises a chain of digitally controlled MOS devices.

It will be appreciated that certain implementations may advantageously employ a combination of techniques such as described in FIGS. 4 to 7.

A bias current generator for less than 70 nA total supply current, according to FIG. 2, FIG. 3, FIG. 6 and FIG. 7, was designed and simulated in a low geometry CMOS process and data confirmed that such circuits can operate from supply voltages lower than 1V.

The on resistance value of mn2 and mn3 of FIG. 6, where the base-emitter voltage difference is reflected, can be modulated by modulating the aspect ratio (W/L) of mn1. The on resistance and the corresponding bias current can be modulated in a range from 1 to 10 just by modulating the aspect ratio of the diode connected device mn1 which sets the bias gate voltage for mn2 and mn3. It will be further appreciated that this variation allows the temperature dependency of the resistance provided by these MOS devices to vary from a dominant PTAT form, to a CTAT form to a temperature insensitive. In this way the temperature coefficient of the bias current can be modulated to be dominant PTAT, constant or dominant CTAT. It will be appreciated that the base-emitter voltage is always PTAT in form but the corresponding current depends on the temperature dependency of the MOS devices "on" resistance in triode region.

Heretofore the present teaching has been described with reference to a bias current generator. The current at the output of the current generator may be converted to a bias voltage by reflecting that generated current at the drain of MOS device mp3 across a MOS device configured as a resistor.

In another aspect of the present teaching, a current generator can be coupled to additional circuitry to provide a temperature independent, or reference source. One way that this may be advantageously provided is by replicating the generated bias current across a chain of series connected MOS transistors, similar to mn2 and mn3. A reference voltage circuit in accordance with this understanding is presented in FIG. 8 where the bias current generator and the start-up blocks are assumed to be the same as in FIG. 6. These blocks are coupled to a reference voltage sub-circuit 4 configured to convert the bias current to a corresponding bias voltage. The bias voltage can be provided as a scaled value of the $\Delta V_{BE}$ voltage used to generate the bias current. In this example the current to voltage convertor comprises a chain of NMOS transistors, mn8, mn9 to mn10, biased with the corresponding bias current from mph. The NMOS transistors mn9 to mn10 are assumed to be biased in triode region, the same as mn2 and mn3, such that across each transistor of the chain a similar voltage to that of the MOS devices mn2 and mn3 is developed. The voltage difference from the node "ref" to the node "a" represents a scaled replica of the base-emitter voltage difference of qp1 to qp2. This voltage is PTAT in form and it balances the temperature coefficient of the voltage at the node "a" which as it is derived from the base emitter of the bipolar transistor qp1, is CTAT in form. The combination of the PTAT and the CTAT voltages generates a temperature insensitive voltage reference at the node "ref". In such a configuration the circuit will be capable of simultaneously providing a PTAT current (from the node o at mp3) and a temperature insensitive voltage reference at the node "ref".

It will be appreciated that if the connection between the stack of MOS devices and the bipolar transistor qp1 is disconnected or decoupled, then the voltage that is provided at the node "ref" will be PTAT in form. In such a configuration the circuit will be capable of simultaneously providing a PTAT current (from the node o at mp3) and a PTAT voltage at the node "ref".

Figure 8:
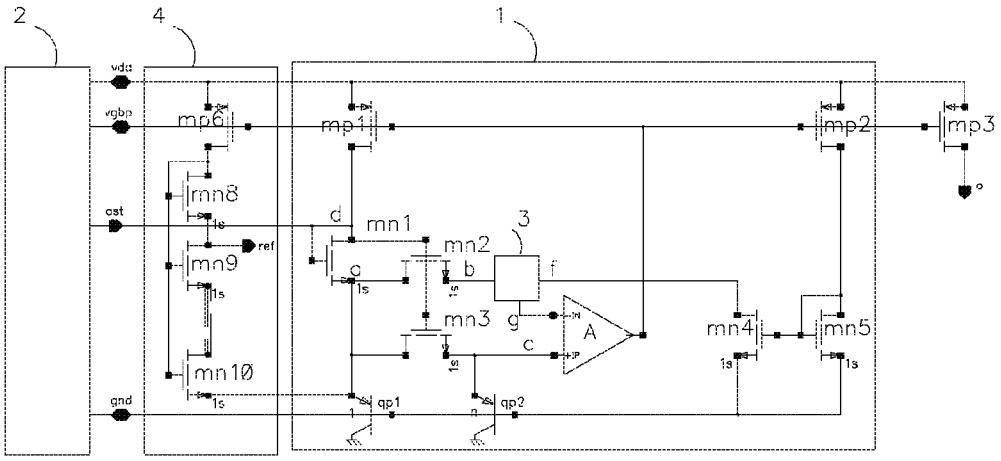
FIG. 8 shows how a current generator per the present teaching can be combined with additional circuitry to provide a voltage generator or a voltage reference.

The reference voltage temperature coefficient can be minimized via the same trimming circuit as that of FIG. 6. As the on resistance of the block 3 of FIG. 8 is modulated, via a digital trimming code, the unity bias current is modulated, up or down, which in turns modulates the PTAT voltage of the reference block.

It will be appreciated that exemplary arrangements of a resistor-less bias current generator and reference voltage circuit according to the present teaching have been described heretofore and that modifications can be made to that described without departing from the spirit and or scope of the present teaching. While not intending to limit the present teaching to any one set of advantages circuits in accordance with the present teaching provide a number of advantages over known implementations including:

- as bias current generator can operate from supply voltage as low as 0.8V;
- as reference voltage can operate from supply voltage lower than 1.5V;
- the unity bias current can be set of the order of nanoamps;
- the circuits according to the present teaching can be implemented in a very low die area with minimum cost;
- the temperature coefficient of the bias current can be modulated to be dominant PTAT,
- constant or dominant CTAT;
- the bias current and the voltage reference according the present patent can be trimmed for high accuracy.

It is however not intended to limit the present teaching to any one set of advantages or features as modifications can be made without departing from the spirit and or scope of the present teaching.

The systems, apparatus, and methods of providing a bias current generator that can be advantageously implemented without resistors and while this has been described above with reference to certain embodiments, a circuit provided in accordance with the present teaching can be used for providing a current or voltage reference.

Additionally, while the base-emitter voltages have been described with reference to the use of specific types of bipolar transistors any other suitable transistor or transistors capable of providing base-emitter voltages could equally be used within the context of the present teaching but given the size dimensions of bipolar transistors it is advantageous that were described with reference to a bipolar that a bipolar transistor—as opposed to a MOS device configured to replicate a bipolar transistor is provided. It is envisaged that each single described transistor may be implemented as a plurality of transistors the base-emitters of which would be connected in parallel.

Such systems, apparatus, and/or methods can be implemented in various electronic devices. Examples of the electronic devices can include, but are not limited to, consumer electronic products, parts of the consumer electronic products, electronic test equipment, wireless communications infrastructure, etc. Examples of the electronic devices can also include circuits of optical networks or other communication networks, and disk driver circuits. The consumer electronic products can include, but are not limited to, measurement instruments, medical devices, wireless devices, a mobile phone (for example, a smart phone), cellular base stations, a telephone, a television, a computer monitor, a computer, a hand-held computer, a tablet computer, a personal digital assistant (PDA), a microwave, a refrigerator, a stereo system, a cassette recorder or player, a DVD player, a CD player, a digital video recorder (DVR), a VCR, an MP3 player, a radio, a camcorder, a camera, a digital camera, a portable memory chip, a washer, a dryer, a washer/dryer, a copier, a facsimile machine, a scanner, a multi-functional peripheral device, a wrist watch, a clock, etc. Further, the electronic device can include unfinished products.

Unless the context clearly requires otherwise, throughout the description and the claims, the words "comprise,""comprising,""include,""including," and the like are to be construed in an inclusive sense, as opposed to an exclusive or exhaustive sense; that is to say, in the sense of "including, but not limited to." The words "coupled" or "connected", as generally used herein, refer to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words using the singular or plural number may also include the plural or singular number, respectively. The words "or" in reference to a list of two or more items, is intended to cover all of the following interpretations of the word: any of the items in the list, all of the items in the list, and any combination of the items in the list. All numerical values provided herein are intended to include similar values within a measurement error.

The teachings of the inventions provided herein can be applied to other systems, not necessarily the circuits described above. The elements and acts of the various embodiments described above can be combined to provide further embodiments. The act of the methods discussed herein can be performed in any order as appropriate. Moreover, the acts of the methods discussed herein can be performed serially or in parallel, as appropriate.

While certain embodiments of the inventions have been described, these embodiments have been presented by way of example only, and are not intended to limit the scope of the disclosure. Indeed, the novel methods and circuits described herein may be embodied in a variety of other forms. Furthermore, various omissions, substitutions and changes in the form of the methods and circuits described herein may be made without departing from the spirit of the disclosure. The accompanying claims and their equivalents are intended to cover such forms or modifications as would fall within the scope and spirit of the disclosure. Accordingly, the scope of the present inventions is defined by reference to the claims.

The invention claimed is:

1. A bias current generator comprising:

a first bipolar transistor and a second bipolar transistor, the second bipolar transistor configured to operate with a different collector current density than the first bipolar transistor to generate a $\Delta V_{BE}$ voltage that is a difference in base-emitter voltages of the first and second bipolar transistors;

a plurality of stacked metal oxide semiconductor (MOS) devices biased in a transistor triode operating region and operatively coupled to the first and second bipolar transistors to generate a reference bias current determined by the $\Delta V_{BE}$ voltage and an on resistance of the stacked MOS devices;

a biasing MOS device, wherein the plurality of stacked MOS devices have a common source/drain connection coupled to a source/drain of the biasing MOS device and wherein a drain voltage of each of the biasing MOS device and the stacked MOS devices is determined by the $\Delta V_{BE}$ voltage; and a plurality of current mirrors and an amplifier, wherein the stacked MOS devices are coupled between the current mirrors and inputs of an amplifier, the stacked MOS devices comprising a first MOS device coupled to a first input of the amplifier and a second MOS device coupled to a second input of the amplifier.

2. The generator of claim 1 wherein the biasing MOS device and the stacked MOS devices include a common gate node.

3. The generator of claim 1 wherein the current mirrors comprise a first current minor including a first set of MOS devices and a second current mirror including a second set of MOS devices separate from the first set of MOS devices.

4. The generator of claim 3 wherein the bias current s provided at a source/drain of a MOS device of the second set of MOS devices.

5. The generator of claim 4 wherein the bias current is related to the source drain voltage of the MOS device of the second set of MOS devices.

6. The generator of claim 5 wherein an output of the amplifier is coupled to a common gate connection of the second set of MOS devices of the current mirrors to generate a source drain voltage of the second set of MOS devices.

7. The generator of claim 6 wherein the second set of MOS devices is coupled to a common gate node of the biasing MOS device.

8. The generator of claim 7 wherein aspect ratios of the MOS devices forming the second set of MOS devices are configured such that a bias voltage provided by the second set of MOS devices to the common gate node of the biasing MOS device is also used to bias the bipolar transistors and to provide a bias current for the first set of MOS devices.

9. The generator of claim 3 wherein the bias current resultant from the $\Delta V_{BE}$ voltage is mirrored across the first set of MOS devices to the second set of MOS devices where it is provided as an output current of the circuit.

10. The generator of claim 9 wherein the output current of the circuit is a scaled value of the bias current as determined by an aspect ratio of individual ones of the MOS devices in the current mirrors.

11. The generator of claim 10 wherein an aspect ratio of either the MOS devices forming the first set of MOS devices or an aspect ratio of the MOS devices forming the second set of MOS devices is used to determine the scaled value of the output current.

12. The generator of claim 3 comprising a start-up circuit; the start-up circuit coupled to the second set of MOS devices and to the common drain gate node of the biasing MOS device to operably provide a gate voltage during start-up operation of the generator.

13. The generator of claim 12 wherein the start-up circuit comprises a plurality of MOS devices.

14. The generator of claim 1 wherein the amplifier is a single stage differential amplifier.

15. The generator of claim 1 wherein the current mirrors include a first current mirror provided by a first set of MOS devices and a second current mirror provided by a second set of MOS devices, and wherein a current biasing each of the first set of MOS devices and the second bipolar transistor is different.

16. The generator of claim 15 comprising a biasing MOS device and a trimmable element, wherein the biasing MOS device and the stacked MOS devices include a common gate node and the trimmable element is coupled between the stacked MOS devices and the biasing MOS device.

17. The generator of claim 16 wherein the trimmable element comprises a chain of digitally controlled MOS devices.

18. The generator of claim 1 comprising a trimmable element provided between the stacked MOS devices and an input to the amplifier, a value of the trimmable element being operably used to vary a value of the $\Delta V_{BE}$ voltage used to generate the bias current.

19. The generator of claim 18 wherein the trimmable element comprises a chain of digitally controlled MOS devices.

20. The generator of claim 1 comprising a current to voltage convertor, configured to convert the bias current to a corresponding bias voltage.

21. The generator of claim 20 wherein the bias voltage is a scaled value of the $\Delta V_{BE}$ voltage used to generate the bias current.

22. A method of generating a bias current comprising:

generating a $\Delta V_{BE}$ voltage using a first bipolar transistor and a second bipolar transistor, wherein the $\Delta V_{BE}$ voltage is related to a difference in base emitter voltages of the first and second bipolar transistors;

reflecting the $\Delta V_{BE}$ voltage across a plurality of stacked MOS devices biased in a transistor triode region using a biasing MOS device to generate a bias current, the bias current being related to the $\Delta V_{BE}$ voltage and an on resistance of the MOS devices wherein each of the biasing MOS device and the plurality of stacked MOS devices share a common gate node, wherein a drain voltage of each of the biasing MOS device and the stacked MOS devices is determined by the $\Delta V_{BM}$ voltage; and mirroring the bias current across a first set of MOS current minoring devices to a second set of MOS current mirroring device and providing an output current using the second set of MOS current mirroring devices.

* * * * *